US006789718B2

(12) United States Patent
Canlas et al.

(10) Patent No.: US 6,789,718 B2
(45) Date of Patent: Sep. 14, 2004

(54) NAIL PLACEMENT DEVICE

(75) Inventors: Prudencio S. Canlas, North Kingstown, RI (US); David J. Simonelli, Coventry, RI (US); David M. McGee, Attleboro, MA (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 0 days.

(21) Appl. No.: 10/244,597

(22) Filed: Sep. 17, 2002

(65) Prior Publication Data

US 2004/0050899 A1 Mar. 18, 2004

(51) Int. Cl.[7] ..... B02C 1/04

(52) U.S. Cl. ..... 227/130; 227/130; 227/107; 227/110; 227/119; 227/9

(58) Field of Search ..... 227/107, 110, 227/119, 9, 130

(56) References Cited

U.S. PATENT DOCUMENTS

| | | | |
|---|---|---|---|
| 2,506,038 | A | 5/1950 | Rakusin |
| 3,260,437 | A | 7/1966 | Parr |
| 3,670,941 | A | 6/1972 | Grinnell et al. |
| 3,708,096 | A | 1/1973 | Burke, Jr. |
| 3,776,445 | A | 12/1973 | Pomeroy |
| 3,820,705 | A | 6/1974 | Beals |
| 3,858,782 | A | 1/1975 | Pomeroy |
| 3,964,661 | A | 6/1976 | Schmidt et al. |
| 4,253,598 | A | 3/1981 | Haytayan |
| 4,319,706 | A | 3/1982 | Halstead |
| 4,485,952 | A | 12/1984 | Weis |
| 4,731,917 | A | 3/1988 | Krowl |
| 4,928,867 | A | 5/1990 | Jensen |
| 4,932,480 | A | 6/1990 | Golsch |
| 5,025,968 | A | 6/1991 | Nasiatka |
| 5,052,607 | A | 10/1991 | Dutton |
| 5,193,730 | A | 3/1993 | Tanaka et al. |
| 5,238,167 | A | 8/1993 | Howard et al. |
| 5,261,587 | A | 11/1993 | Robinson |
| 5,452,835 | A | 9/1995 | Shkolnikov |
| 5,579,975 | A | 12/1996 | Moorman |
| 5,803,338 | A | 9/1998 | Singer et al. |
| 5,810,239 | A | 9/1998 | Stich |
| 6,209,770 | B1 | 4/2001 | Perra |
| 6,279,808 | B1 | 8/2001 | Larsen |

FOREIGN PATENT DOCUMENTS

| | | |
|---|---|---|
| EP | 0 038 396 | 10/1981 |

*Primary Examiner*—Rinaldi I. Rada
*Assistant Examiner*—Michelle Lopéz
(74) *Attorney, Agent, or Firm*—Pillsbury Winthrop LLP

(57) ABSTRACT

A fastener driving device including a positioning mechanism for positioning a nail into an opening in a workpiece. The positioning mechanism includes an opening locating structure movably connected to the movable assembly of the contact trip assembly and adapted to extend into the opening so as to align the nosepiece with respect to the opening. The opening locating structure is movable relative the movable assembly of the contact trip assembly between an extended position and a retracted position and biased toward the extended position by a first biasing spring to facilitate locating of the opening, and movable to the retracted position when the opening locating structure is pressed against a workpiece. The positioning mechanism further includes a guiding structure movably connected to the nosepiece structure, the guiding structure being biased by a spring to extend forwardly to guide the fastener in a driving track inside the nosepiece.

29 Claims, 8 Drawing Sheets

NAIL PLACEMENT DEVICE

BACKGROUND

This invention relates to fastener driving devices and, more particularly, to fastener driving devices of the portable type having a nail placement device or nail positioning mechanism.

Fastener driving tools for driving fasteners such as nails are commonly used in industry and commerce. The fastener driving tools are power operated and may be pneumatically powered, electrically powered or combustion powered. The fasteners are generally supplied from a collated strip or stick of fasteners disposed in a magazine assembly coupled to a nosepiece portion of the fastener driving tool housing. Typically a fastener feeding device advances the fasteners through the feed track of the magazine assembly toward and into a drive track in the nosepiece portion of the fastener driving tool. In the case of pneumatically driven tools, the housing of the fastener driving tool comprises a handle reservoir to store compressed air, a cylinder within the housing, a piston within the cylinder, a driver connected to the piston, and a main valve to provide pressurized air to operate the piston.

Fastener driving tools usually include a trip assembly mounted on the nosepiece and operatively associated with a trigger mechanism to prevent the driver from being actuated when the nosepiece is not in contact with a workpiece. Contact trip assemblies are often sequentially associated with the trigger mechanism so that when the nosepiece is placed in contact with the workpiece, the trip assembly moves with respect to the tool frame and places the trigger mechanism in an active condition so that the driver can be actuated by movement of the trigger mechanism through its actuation stroke.

In some instances, fastener driving tools may also include a positioning mechanism or a nail placement device for positioning the tool relative to an opening in a workpiece, such as a metallic structure, to be fastened to another adjacent workpiece, such as a wooden structure.

Positioning or pointing mechanisms have already been used for aligning the nosepiece with respect to the opening in a workpiece so that a fastener (such as a nail) can be precisely driven through the opening. For example, U.S. Pat. No. 5,452,835 discusses a positioning mechanism for powered fastener-driving tool. The mechanism comprises a probe having a tapered end adapted to extend into the opening of the workpiece. The mechanism comprises a pivot for mounting the probe to an actuator operatively mounted to the nosepiece. The probe is mounted on the pivot so as to provide a pivotal movement of the probe relative to the actuator. When a nail is driven by the tool, the head of the nail engages a surface of the probe thus pivoting the probe from the opening as the tool recoils.

Another positioning mechanism found in the commerce is one sold under the tradename of "THE LOCATOR" manufactured by Range Bull Technologies. A perspective view of this positioning mechanism is shown in FIG. 9, and a cross-section view is shown in FIG. 10. Positioning mechanism 200 comprises a rigid structure 201 having an elongated bar-like portion 203 and an annular portion 205. The bar-like structure comprises opening 207 for fastening the positioning mechanism 200, with a screw or the like, on a contact trip mechanism (not shown) such that the positioning mechanism forms an extension of the contact trip mechanism. The nosepiece portion of the fastener driving tool comes in contact with the inside surface of the annular portion 205. The annular portion 205 includes an integral opening locating element 202. The opening locating element 202 is located at a lower extremity of the annular portion 205 in general alignment with the bar-like structure 203.

The opening locating element 202 has a half-conical shaped hole entering portion 209. Opening locating element 202 is integrally formed with the annular portion 205. Specifically, opening locating element 202 does not move relative to the bottom portion 204 of the annular portion 205, thus the opening locating element 202 does not move relative to the rigid structure 201 of the positioning mechanism 200. Positioning mechanism 200 also comprises nail pusher 206 pivotally connected to the rigid structure 201 and biased by biasing spring 208 such that the pointed end of a nail 210 is pushed against a tapered arcuate surface 211 of the hole entering portion 209. Nail pusher 206 has a rod-like shape extending from pivot point 212 to pointed end 214 which in turn is brought in contact with nail 210. As mentioned previously, the opening locator 202 forms an integral part of the annular portion 205. Therefore, opening locator 202 does not move relative to bottom portion 204 of positioning mechanism 200.

The prior art is limited in its performance. For example, due to the bulkiness of the opening locator in the positioning mechanism "THE LOCATOR" it is hard to see the opening locator 202 and locate an opening at the same time which may lead to jamming and/or missing the opening. Therefore, it is desirable to overcome these and other limitations thus allowing overall improved performance and reduced cost of the fastener tool.

BRIEF DESCRIPTION OF THE INVENTION

In accordance with the principles of one aspect of the present invention, a fastener driving device comprises a frame structure presenting a handle portion constructed and arranged to be gripped by a user enabling the user to handle the device in portable fashion, a nosepiece structure operatively fixed with respect to said frame structure defining a fastener drive track, a fastener driving element movable through the drive track. The fastener driving device also includes a power operated fastener driving system carried by the frame structure constructed and arranged to move said fastener driving element through successive operating cycles each including a drive stroke and a return stroke and a magazine assembly carried by said frame structure having fixed structure defining a fastener feed track leading to the drive track and movable structure constructed and arranged to enable a package of fasteners to be loaded in said magazine assembly and fed along the feed track so that the leading fastener of the fastener package is moved into the drive track to be driven outwardly thereof into a workpiece during the drive stroke of the fastener driving element. The fastener driving device further includes an actuating mechanism constructed and arranged to actuate the power operated driving system including a manually actuatable trigger assembly and a contact trip assembly. The contact trip assembly comprising a trigger enabling portion and a movable assembly coupled to the trigger enabling portion, the contact trip assembly being constructed and arranged to be movable between an extended position and a retracted position whereby the trigger enabling portion enables the trigger mechanism to activate the fastener driving element when actuated by a user when said contact trip assembly is in the retracted position and disables the trigger mechanism when the contact trip assembly is not in the retracted position. The contact trip assembly is constructed and arranged to be biased toward the extended position and to be moved toward the retracted position when the movable assembly engages a workpiece by pressing the frame structure toward the workpiece, thereby moving the contact trip assembly with respect to the nosepiece.

The fastener driving device further comprises a positioning mechanism constructed and arranged to position the nosepiece structure into an opening in a first workpiece such that a fastener is driven through the opening to fasten the workpiece to a second workpiece. The positioning mechanism includes an opening locating structure movably connected to the movable assembly of the contact trip assembly and adapted to extend into the opening so as to align the nosepiece with respect to the opening. The opening locating structure is movable relative the movable assembly of the contact trip assembly between an extended position and a retracted position and biased toward the extended position by a first biasing spring to facilitate locating of the opening, and movable to the retracted position when the opening locating structure is pressed against the first workpiece. The positioning mechanism further includes a guiding structure movably connected to the nosepiece structure, the guiding structure being biased by a second spring to extend forwardly to guide the fastener in the driving track.

In one embodiment, the guiding structure is biased by the biasing spring such that when a fastener is introduced into the drive track the guiding structure forces a pointed end of said fastener to be proximate to the opening locating structure.

In one embodiment, the guiding structure is constructed and arranged to pivot around a pivot axis disposed at an extremity of said guiding structure. In another embodiment, the guiding structure is constructed and arranged to slide perpendicularly to a driving axis defined by the driving track in the nosepiece. In one embodiment, the guiding structure has an oblong-like shape. In an alternate embodiment, the guiding structure has an sector-like shape.

Another aspect of the invention is to provide a fastener driving device including among others an actuating mechanism including a trigger assembly constructed and arranged to be actuated by a manual movement and a contact trip assembly constructed and arranged to be actuated by a movement of the housing into a workpiece with said drive track at a fastener driving position with respect thereto. The actuating mechanism is constructed and arranged to actuate the power operated system in response to a predetermined actuation of the trigger assembly and the contact trip assembly. The contact trip assembly is constructed and arranged to be moved into engagement with a plied workpiece including a member having an opening therethrough and a substrate to which the member is to be attached by a fastener extended through the opening and into the substrate.

The contact trip assembly includes a trigger enabling structure movable with respect to the housing, and cooperating with the trigger assembly, an opening locating structure constructed and arranged to engage within the opening to initiate the actuation of the contact trip assembly after which during an initial contact trip actuating movement of the housing, the trigger enabling structure moves with the housing and with respect to the opening locating structure and a final movement of the housing to actuate the contact trip assembly. The housing is moved with respect to both the opening locating structure and the trigger enabling structure.

Other aspects of the present invention is to provide a device of the type describe above which is combined with other features hereafter described in detail.

DETAILED DESCRIPTION OF PREFERRED EMBODIMENTS

Figure 1:
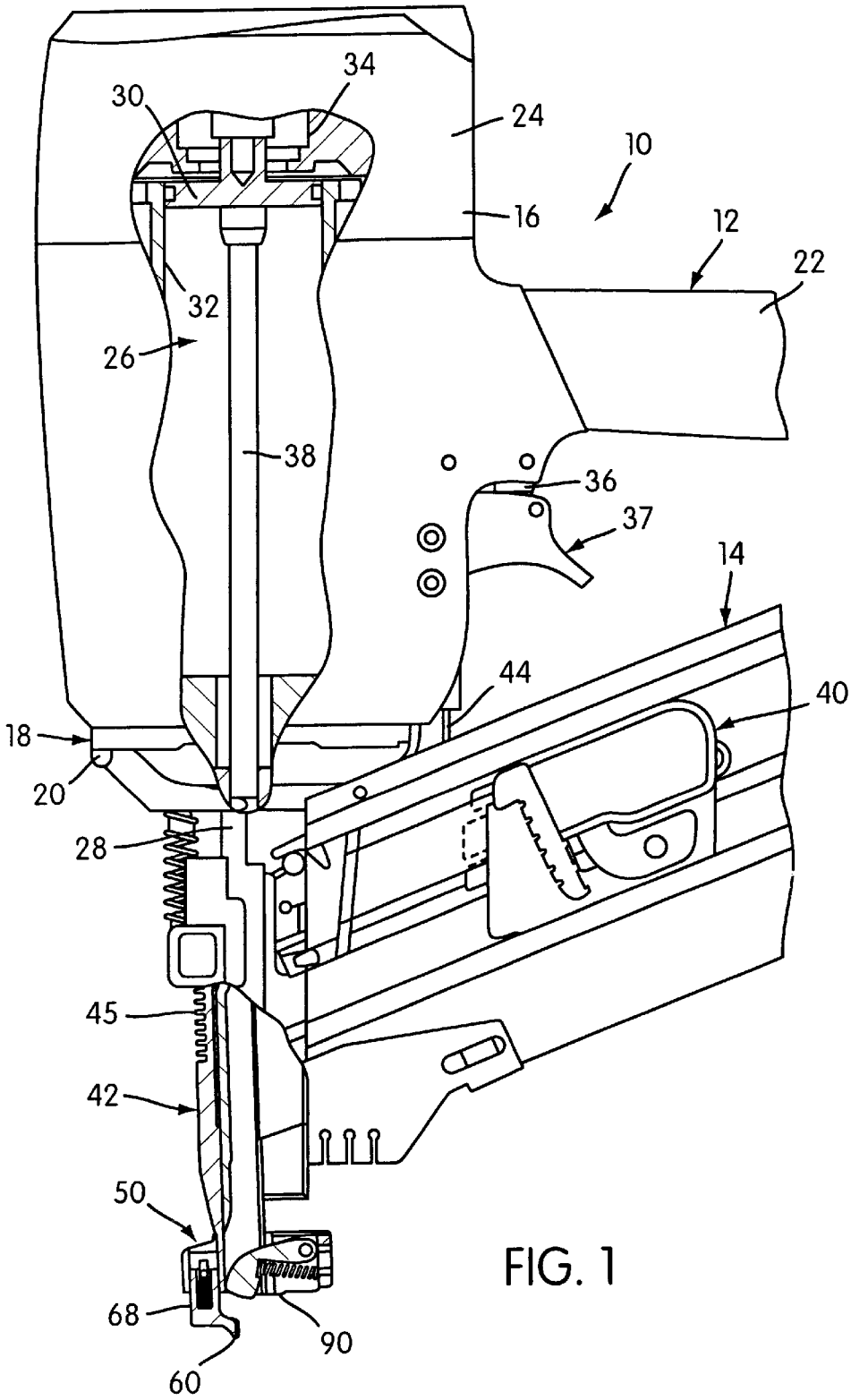
FIG. 1 is a sectional view of the fastener showing the parts in the normal inoperative position thereof.

Referring now to the drawings, more particularly referring to FIG. 1, there is shown therein a fastener driving device, generally indicated at 10, which embodies the principles of the present invention. While the device could be adapted to drive any type of fastener, as shown, the device 10 is particularly adapted to drive nails, which are supplied in the form of an angled stick package. A similar fastener has been described in a commonly assigned U.S. Pat. No. 6,209,770 the contents of which are incorporated herein by reference.

The fastener driving device 10 includes a housing assembly 12 and a fastener magazine assembly 14. The housing assembly 12 includes a housing structure 16 which may be of conventional construction and a nosepiece assembly 18 secured thereto by fasteners 20.

The housing structure 16 includes a hollow handle grip portion 22, the interior of which forms a reservoir for pressurized air supplied by a conventional pressurized air source (not shown) in communication therewith. The grip portion 22 is integrally formed with a vertically extending portion 24 of the housing structure 16 which contains a fastener driving mechanism 26 of conventional construction. A portion of the housing structure 16 has been broken away in FIG. 1 to show the construction of the fastener driving mechanism 26.

The fastener driving mechanism 26 is constructed and arranged to drive a fastener through a longitudinally extending fastener driving track 28 outwardly into a workpiece when the fastener driving mechanism 26 is selectively actuated by a worker using the fastener driving tool 10.

The fastener driving mechanism 26 includes a piston 30 mounted within a cylindrical chamber 32 in the housing structure 16 for movement from an upper position (shown in FIG. 1) through a drive stroke into a lowermost position and from the lowermost position through a return stroke back to the upper limiting position. A main valve 34 controls the flow of pressurized air from the reservoir in the handle grip portion 22 to the upper end of the cylindrical chamber 32 to affect the driving movement of the piston 30 through its drive stroke.

The main valve 34 is pilot pressure operated and the pilot pressure chamber thereof is under the control of an actuating valve generally indicated at 36. The main valve 34 and actuating valve 36 maybe of known construction, an example of which is disclosed in commonly assigned U.S. Pat. No. 3,708,096, the disclosure of which is hereby incorporated by reference in its entirety into the present application. The fastener driving mechanism described herein is exemplary only and is not intended to be limiting. It is understood that the present invention can be used on a power operated fastener driving device having a fastener driving mechanism of any conventional construction and is not limited to the representative embodiment disclosed in the present application; it can also be understood that the present invention is not limited to pneumatically operated fastener driving devices and can be incorporated in fastener driving devices that are powered by any conventional power source including internal combustion powered devices and electromagnetically powered devices.

The actuating valve 36 is actuated by a trigger mechanism, generally designated 37. The structure and operation of the trigger mechanism is discussed below when the operation of the device 10 is described. Structures are provided within the housing structure 16 to affect the return stroke of the piston 30. For example, such structure may be in the form of a conventional plenum chamber return system such as that disclosed in the incorporated U.S. Pat. No. 3,708,096 United States patent reference.

A fastener driving element 38 is suitably connected to the piston 30 and is slidably mounted within the fastener driving track 28 formed in the nosepiece assembly 18. The fastener magazine assembly 14 is operable to receive a supply of fasteners (not shown) and to feed the leading fastener in the nosepiece assembly 18 into the fastener driving track 28 to be driven by the fastener driving element 38. A fastener feeding mechanism 40 is provided as part of the fastener magazine assembly 14. The fastener feeding mechanism 40 is spring biased in a conventional manner to move toward the second end of the magazine assembly so that when the mechanism 40 is positioned behind a supply of fasteners (not shown) the fastener feeding mechanism 40 pushes the fasteners toward and into the fastener driving track 28.

The manually actuatable trigger mechanism 37 and a contact trip assembly 42 cooperate to form an actuating mechanism which is constructed and arranged to actuate a power operated driving system such as the actuating valve 36. The contact trip assembly 42 is mounted so as to extend outwardly of the nosepiece 18 to be actuated when the device 10 is moved into operative engagement with a workpiece. The contact trip assembly 42 includes a trigger enabling portion 44 and a movable assembly 45 coupled to the trigger enabling portion 44 and movably connected to the nosepiece 18. When the movable assembly 45 of the contact trip assembly 42 is in a retracted position (relative to the housing structure 16 of the fastener driving device 10) when brought in contact with a workpiece, the trigger enabling portion 44 conditions the trigger and places it in an active state or condition so that manual movement of the trigger mechanism 37 will actuate the fastener driving mechanism 26. When the movable assembly 45 in the contact trip assembly 42 is in the extended position (relative to the body of the housing structure 16 of the fastener driving device 10), the trigger enabling portion 44 disables the trigger mechanism 37 to prevent the fastener driving tool 10 from being accidentally actuated if the trigger mechanism is moved through its actuation stroke.

The present invention is not primarily concerned with the structure and operation of the fastener driving mechanism 26, or with the structure of the housing assembly 12, all of which may be conventional. The focus of the present invention is, rather, the structure and operation the contact trip assembly including a positioning or pointing mechanism constructed and arranged to position the fastener driving device relative to an opening in a workpiece, such as but not limited to, a metallic structure, to be fastened to another adjacent workpiece, such as but not limited to, a wooden structure.

The positioning mechanism, generally indicated at 50, is capable of locating an opening in workpiece. The positioning mechanism 50 is fastened with a fastener such as a screw or the like to a movable assembly 45 of contact trip assembly 42 such that positioning mechanism 50 constitutes an extension of the contact trip assembly 42.

The positioning mechanism comprises guiding structure 90 and opening locating structure 60 movably connected to the movable assembly 45 of the contact trip assembly 42 and biased by spring 68 in an extended position as shown in FIG. 1.

Figure 2:
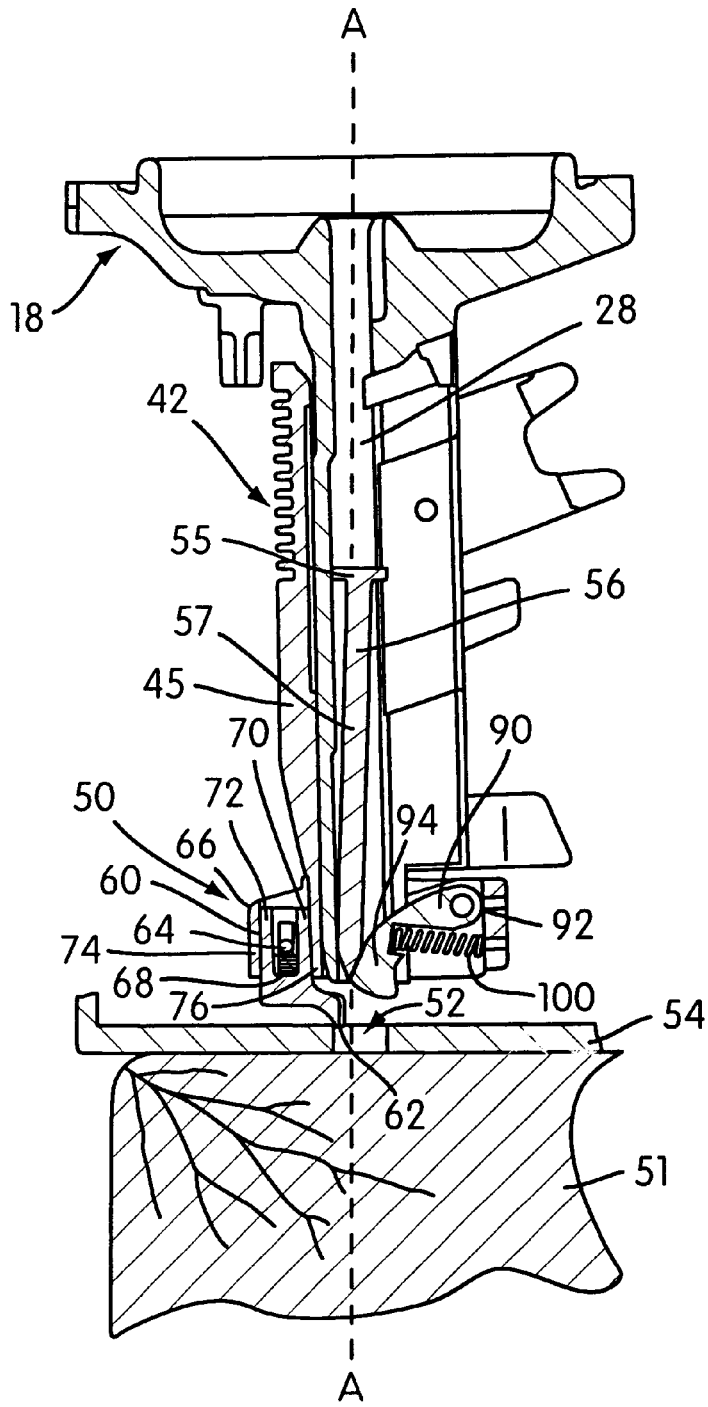
FIG. 2 is a section view of the positioning mechanism according to one embodiment of the present invention.

Referring more particularly to FIG. 2, it is shown in detail a nosepiece assembly 18 which includes nail positioning mechanism 50, capable of locating an opening 52 in workpiece 54, hereinafter more specifically explained to allow placement of a nail 56 into the opening 52.

The positioning mechanism comprises opening locating structure 60. In one embodiment, the opening locating structure 60 has a tapered end 62 adapted to extend into the opening 52. The opening locating structure 60 is movably connected to an extremity 66 of movable assembly 45 in contact trip 42 in nosepiece 18 using attachment member 64. The opening locating structure 60 is prevented from rotation by the two flats 70 and 72 which are held by mating members 74 and 76 at the extremity 66 of the contact trip 42. The opening locating structure 60 is allowed to slide up and down relative to the extremity 66 of the contact trip 42. Specifically, the opening locating structure 60 has an asymmetric Y-shape where a "fork" portion correspond to the two flat portions 70 and 72 and a pointed portion correspond to the tapered end 62. In this embodiment, the opening locating structure 60 is biased to extend away from extremity 66 of movable assembly 45 by spring 68 disposed between the two flat portions 70 and 72 such that when the opening locating structure is brought in contact with workpiece 54 the opening locating structure retracts upwardly to allow nail 56 to penetrate into opening 52 in workpiece 54. The opening locating structure 60 is shown in this Figure in a retracted position relative to the extremity 66 of movable assembly 45 of contact trip assembly 42.

During operation, the fastener driving device 10 is positioned in contact with the workpiece 54 having opening 52, in a manner as to allow the opening locating structure 60 to locate the opening 52 (the tapered end 62 partially covers opening 52). Prior to bringing the opening locating structure into the opening 52, the opening locating structure 60 is in an extended position relative to the extremity 66 of movable assembly 45 of contact trip assembly 42. When the opening locating structure is brought in contact with the opening 52, the opening locating structure 60 retracts relative to the extremity 66 of movable assembly 45 of contact trip assembly 42. At the same time the movable assembly 45 in contact trip assembly 42 retracts relative to the housing structure 16 of the fastener driving device 10. Thus, the trigger enabling portion 44 enables the trigger mechanism 37 to allow actuation of the trigger mechanism. The trigger mechanism 37 is manually pulled releasing a compressed gas (e.g., air) which actuates the piston 30 comprising the driver 38 for driving the nail 56 through the opening 52 of workpiece 54 which can be, for example a metallic structure, into another workpiece 51 which can be, for example, a wooden structure. Specifically, the nail 56 is introduced in the drive track 28 in nosepiece 18. The nail 56 is guided through the drive track 28, such that the driver 38 strikes the nail head 55, thus allowing the nail to travel with its pointed end through the opening 52 in workpiece 54 (eg., metallic structure) and into workpiece 51 (eg., wooden structure). At the end of the drive stroke the nail head 55 is brought into abutment with the metallic structure 54 thus attaching the metallic structure 54 to the wooden structure 51.

The language which specifies that there is movement between the opening locating structure and the contact trip assembly or the movement of the contact trip assembly between its extended position and retracted position is understood to move relative to the housing assembly whereas in fact the movement takes place with respect to the workpiece.

Figure 3:
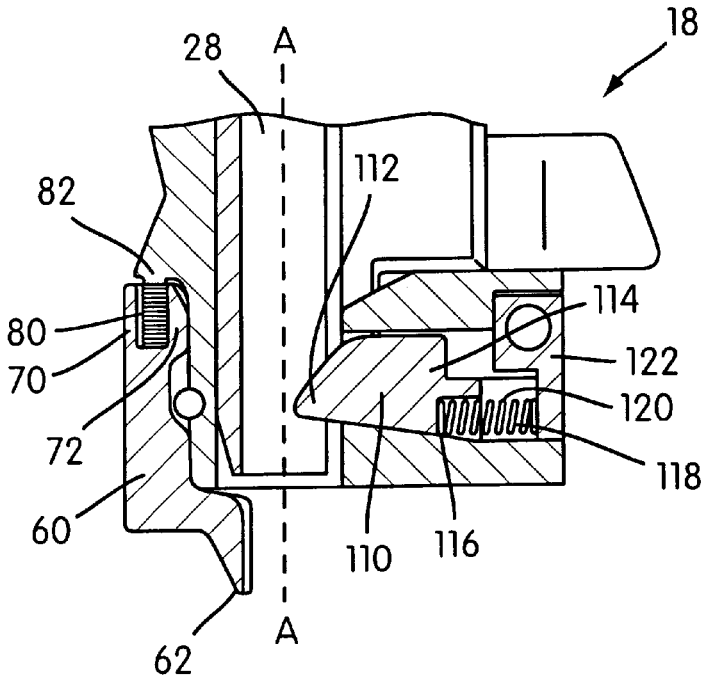
FIG. 3 is a section view of the positioning mechanism according to another embodiment of the present invention.

Referring now to FIG. 3, a biasing spring 80 is positioned between the two flat portions 70 and 72 and disposed in surrounding relation with portion 82 of the extremity 66 of the contact trip 42. An end of the biasing spring 80 comes in contact with the portion 84 of the "Y-shape" while the other end of the biasing spring 80 abuts on the portion 82 of the extremity 66. Therefore, the spring 80 biases the opening locating structure in an extending position such that when the tapered end 62 of opening locating structure 60 is positioned inside opening 52 in a workpiece 54 the biasing spring is compressed. When the opening locating structure is removed from the workpiece the spring extends back to its initial position to facilitate viewing of an opening in the workpiece thus allowing easier placement of the opening locating structure in the opening. When the opening locating structure is brought into contact with the opening in the workpiece, the opening locating structure retracts upwardly allowing nail 56 to be driven through the opening 52.

In one embodiment, the tapered end 62 of opening locating structure 60 is shaped as a half of cone as illustrated in FIG. 3. This shape facilitates guiding the end 62 into the opening 52 in the workpiece 54. When the end 62 is inside opening 52, the end fills approximately half of the opening 52 at the margin of the opening 52. When nail 56 is driven by the fastener device 10, the fastener driving device 10 recoils upwardly thus allowing nail 56 to enter opening 52. Because of the conical shape of end 62 of opening locating structure 60, the tapered end acts as a guide surface operating against the margin of the opening as the tool recoils thus allowing nail 56 to penetrate into opening 52 while the end 62 clears the opening. The conical shape of the tapered end allows the opening locating structure to stay longer in the opening thus allowing the pointed portion of the nail to find the opening which results in a more accurate positioning of the nail.

Referring back to FIG. 2, the positioning mechanism 50 also comprises guiding structure 90. Guiding structure 90 is located at the extremity of nosepiece 18. In one embodiment, guiding structure 90 has an oblong shape or "L-shape" having a pivot axis positioned substantially at its end 92. The other end 94 of the guiding structure 90 is arranged to be in contact with a portion of the nail 56. A biasing spring 100 keeps the end 94 of guiding structure 90 in contact with a portion of the nail 56. In this way, the nail is guided inside track 28 to allow precise placement the nail 56 into the opening 52 in the workpiece 54. The spring 100 is fixed at one end by portion 102 in nosepiece 18 while the other end of spring 100 presses against guiding structure 90 such as to allow the guiding structure 90 to swing or pivot forwardly to press against a portion of nail 56.

During a drive stroke the fastener driving element 38 pushes on the head of the nail 56 forcing the nail to travel within the fastener driving track 28 along drive axis AA. The diameter of head 55 of the nail 56 being larger than the diameter of stem 57 of nail 56, the diameter of the fastener driving track 28 is selected to allow free translation of the nail head within driving track 28 along drive axis AA. However, because the stem 57 of nail 56 has a diameter smaller than the diameter of the head 55 of the nail, the pointed end of the nail may move freely in a direction perpendicular to axis AA which may lead to the head missing the opening 52. Therefore, to circumvent this problem, during the travel phase of the nail inside driving track 28 the extremity 94 of guiding structure 90 is pushed by biasing spring 100 against nail 56 such that the pointed tip of nail 56 is constrained to be as close as possible to the tip 62 before entering opening 52.

In another embodiment, the guiding structure does not pivot around an axis. For example, as illustrated in FIG. 3, guiding structure 110 is positioned such that it slides perpendicular to drive axis AA in the fastener driving track 28. Guiding structure 110 has a forward end 112 and rearward end 114. Forward end 112 of the guiding structure 110 is arranged to be in contact with a portion of the nail 56 (shown in FIG. 2). A spring 120 is biased to keep the forward end 112 of guiding structure 110 in contact with a portion of the nail 56 (shown in FIG. 2). The rearward end 114 of guiding structure 110 presses against end 116 of biasing spring 120. In turn, the end 118 of spring 120 presses against portion 122 in nosepiece 18. In this way, the guiding structure 110 is forwardly biased by spring 120 such as to allow the forward portion 112 of guiding structure 110 to press against a portion of a nail 56 (not shown in this figure but shown in FIG. 2).

Similarly to the previous embodiment, the head 55 of the nail 56 having a diameter larger than stem 57 of the nail 56, the diameter of the fastener driving track 28 is constructed to allow free translation of the nail head 55 within driving track 28 along drive axis AA. However, because the stem 57 of the nail 56 has a diameter smaller than the diameter of the head 55 of nail 56, the tip of the nail may move freely in a direction perpendicular to drive axis AA which may lead to the head missing the opening (shown in FIG. 2). Therefore, to circumvent this problem, during the travel phase of the nail inside driving track 28, the extremity 112 of guiding structure 110 is pushed by biasing spring 120 against nail 56 (shown in FIG. 2) such that the tip of nail is constrained to be as close as possible to the tip 62 of the opening locating structure 60 before entering opening 52 (shown in FIG. 2).

Figure 4:
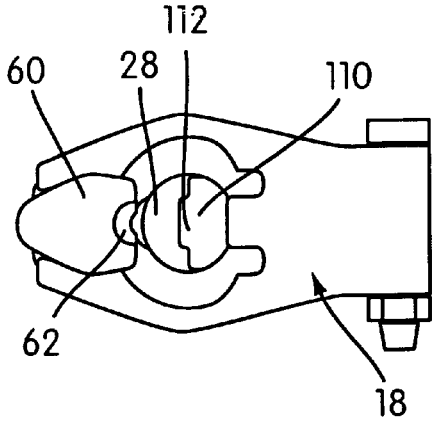
FIG. 4 is a bottom view of the nosepiece of the fastener driving device showing parts of the embodiment of the positioning mechanism illustrated in FIG. 3.

FIG. 4 shows the bottom view of the nosepiece 18 and the different locations of the opening locating structure 60 with its tip 62, the guiding structure 110 with its forwardly extending portion 112 and an extremity (lumen) of driving track 28 where a nail (not shown) exits the fastener driving device 10.

Figure 5:
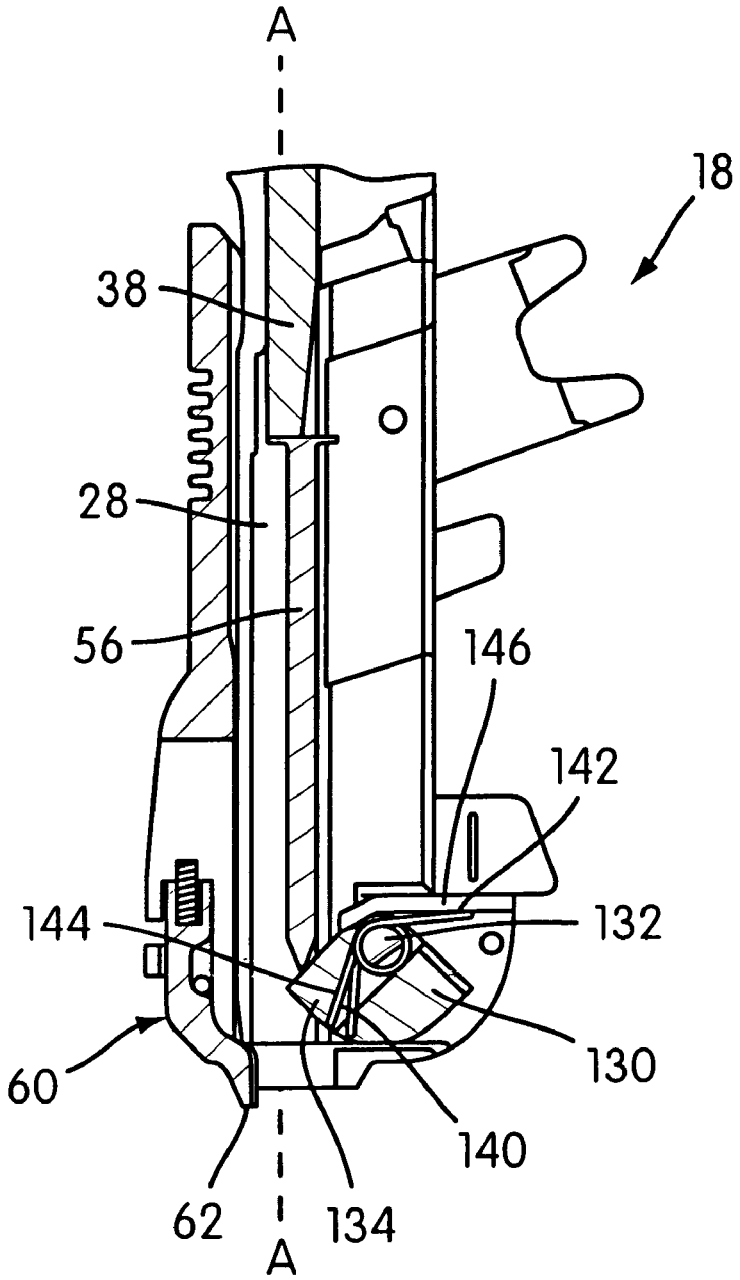
FIG. 5 is a section view of the positioning mechanism according to an alternative embodiment of the present invention.

In an alternative embodiment, the guiding structure is modified to minimize loading on the biasing spring during traveling of the nail in the fastener driving track. The guiding structure is designed to minimize the velocity after impact of the nail head by maximizing its weight while maintaining the guiding structure relatively compact. For example, as illustrated in FIG. 5, guiding structure 130 has an arcuate-like or sector-like shape. The guiding structure 130 has a pivot axis positioned substantially at pivot point 132 located at a proximity of the center of the circle forming the "sector." The guiding structure 130 is arranged in the extremity of the nose piece 18 such that its portion 134 is brought in contact with the nail 56. A spring 140 is biased to keep the end 134 of guiding structure 130 in contact with a portion of the nail 56. In this way the nail is guided inside drive track 28 to allow precise placement of the nail 56 into the opening 52 (shown in FIG. 2) in the workpiece 54 (shown in FIG. 2). The spring 140 has first arm 142 abutting against portion 146 of nosepiece 18, and second arm 144 pressing against guiding structure 130 such that the guiding structure is pivoted forwardly to press against a portion of nail 56.

Similarly to the previous embodiments, during a drive stroke the fastener driving element 38 pushes on the head of the nail 56 forcing the nail to travel within the fastener driving track 28 along drive axis AA. The head of the nail 56 having a diameter larger than a stem of the nail, the diameter of the fastener driving track 28 is constructed to allow free translation of the nail head within driving track 28 along drive axis AA. However, because the stem of the nail has a diameter smaller than the diameter of the head of the nail, the tip of the nail may move freely in a direction perpendicular to axis AA which may lead to the head of the nail missing the opening 52 (shown in FIG. 2). Therefore, to circumvent this problem, during the travel phase of the nail inside driving track 28 the extremity 134 of guiding structure 130 is pushed by biasing spring 140 against nail 56 when guiding structure 130 pivots around its pivot point 132 such that the tip of nail is constrained to be closer to the tip 62 of the opening locating structure 60 before entering opening 52 (shown in FIG. 2).

Figure 6:
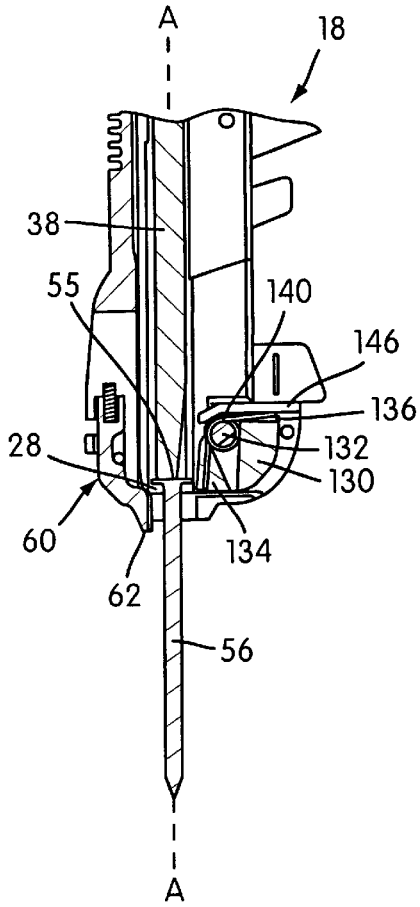
FIG. 6 is sectional view of the positioning mechanism showing the nail extending down and the guiding structure is retracted.

FIG. 6 shows the position of guiding structure 130 when nail 56 exits the nosepiece 18. This Figure illustrate when the head 55 of the nail 56 hits portion 134 of guiding structure 130, the guiding structure pivots such that it clears the driving track 28 for the nail head 55 to exit the nosepiece 18. The guiding structure 130 pivots under the striking force (impulsion) of the nail 56 which leads the portion 136 of the guiding structure 130 to strike portion 146 in nosepiece 18. In order to avoid breakage of the guiding structure under repeated strikes, an elastomeric material may be applied to portion 146 to absorb some of the impact of the guiding structure striking portion 146. The elastomeric material may be selected from conventional elastomeric material used in fastening tools. For example, the elastomeric material can be a relatively soft plastic.

Figure 7:
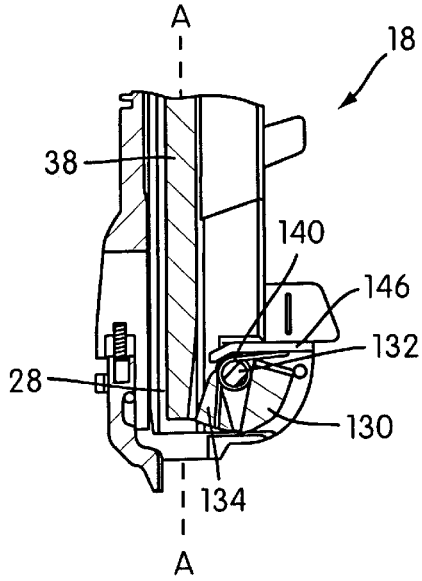
FIG. 7 is sectional view of the positioning mechanism showing the guiding structure in the biased position.
Figure 8:
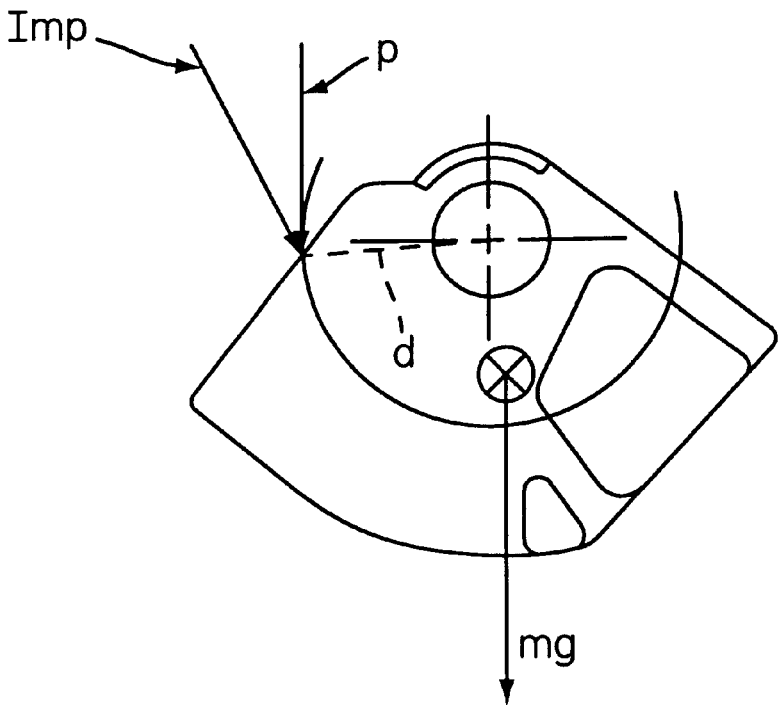
FIG. 8 is a sectional view of the guiding structure showing parameters pertinent for the calculation of angular velocity.
Figure 9:
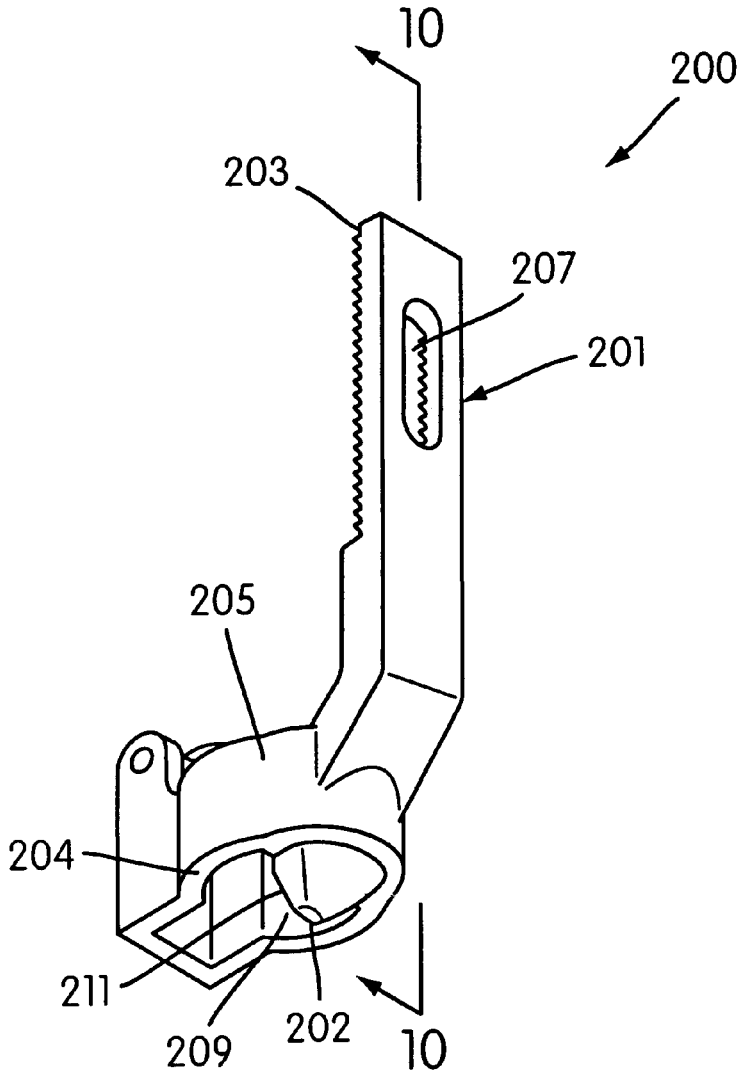
FIG. 9 PRIOR ART
FIG. 9 is a perspective view of a prior-art positioning mechanism.
Figure 10:
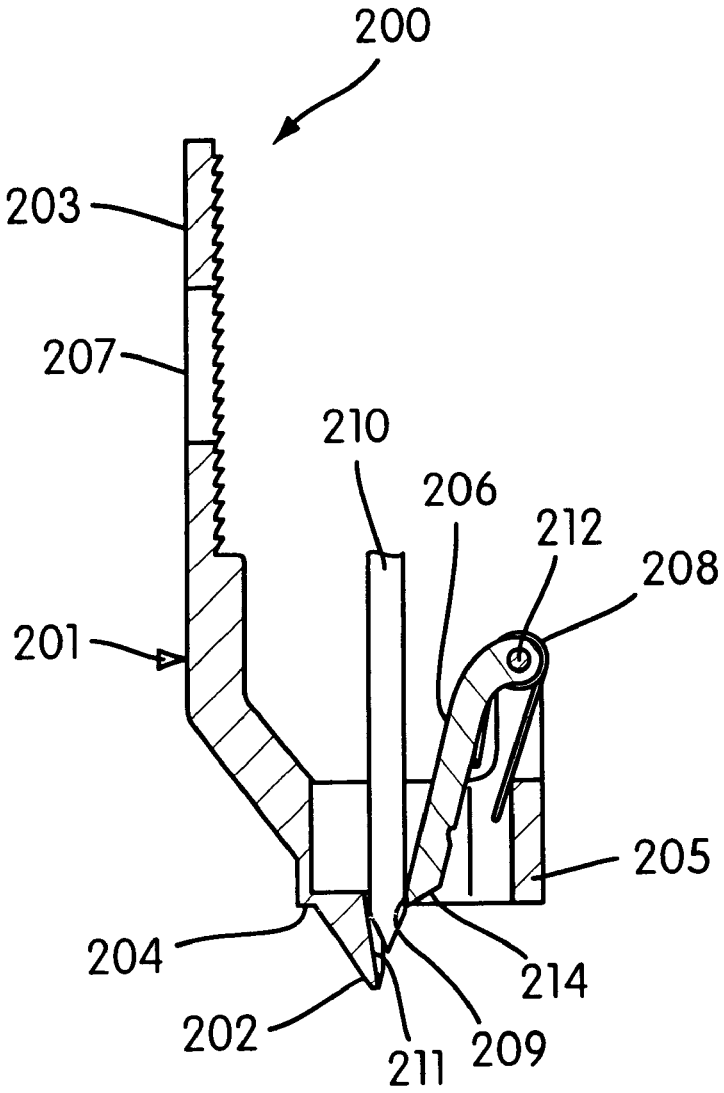
FIG. 10 PRIOR ART
FIG. 10 is a cross-section of the prior art positioning mechanism illustrated in FIG. 9.

FIG. 7 shows the position of the guiding structure when the nail 56 (not shown) has completely exited from drive track 28. In particular, it is shown that the guiding structure returns to its biased initial position by the momentum exerted by the biasing spring 140. During the operation of the fastener driving device, the guiding structure 130 pivots back and forth between a biasing position where the guiding structure 130 holds the nail 56 in the driving track 28 as shown, for example, in FIG. 5, and a position where the guiding structure 130 clears a passage in the driving track 28 under the striking force of the driving element 38 as shown, for example, in FIG. 6. Therefore, the guiding structure 130 oscillates between two angular positions with a certain angular velocity.

It has been found that the higher is the angular velocity, the more likely the biasing spring 140 breaks. In order to increase the lifetime of spring 140, the guiding structure is designed to minimize load on the biasing spring during traveling of the nail in the fastener driving track. Specifically, the guiding structure is designed to minimize the velocity after impact of the nail head by maximizing its weight while maintaining a relatively compact guiding structure. The relationship between angular momentum, radius of gyration, mass of guiding structure and other pertinent parameters explaining the motivation behind one design of the guiding structure of the present invention will be outlined below.

The angular momentum L of a rigid body with a moment of inertia I rotating with angular velocity ω is:

$$L=I\omega \tag{1}$$

The angular momentum is also defined as:

$$L=pd \tag{2}$$

where p is the impulsion (p being the component of the impulsion vector imp tangent to the pivot circle) and d is the normal distance (radius) from the center of the pivot axis to the impact point (the point where the nail impacts the guiding structure).

From equation (1) and equation (2) the following equation is obtained:

$$\omega=pd/I \tag{3}$$

The moment of inertia of a body is defined as:

$$I=mR^2 \tag{4}$$

where m is the mass of the body and R is radius of gyration, i.e. the distance between the center where the mass is concentrated to achieve a moment of inertia $I=m\ R^2$.

From equation (3) and equation (4) the following equation is obtained:

$$\omega=pd/mR^2 \tag{5}$$

From this equation, it can be understood that in order to reduce the angular velocity ω one may reduce the distance d and/or increase the mass m and the radius of gyration R. The radius of gyration being quadratic in equation 5, it will have the largest effect upon the angular velocity. The radius of gyration depends on the shape of the guiding structure as well as the location of the pivot axis. The farther the pivot axis is from the center of gravity of the guiding structure the larger is the moment of inertia (or the radius of gyration).

In the embodiment illustrated in FIG. 2. The guiding structure has an oblong shaped form "L-shape" and the pivot axis is placed at the edge of the "L-shape" (extremity 92). Indeed, one can understand that the moment of inertia is higher when the pivot axis is placed at that location. On the other hand because of the elongated shape of the guiding structure the nail tip will impact the guiding structure at the other extremity (extremity 94) of the L-shape, as illustrated in FIG. 2, which implies that the value of the distance d from the impact point to the pivot point is the largest. Consequently, even though one may think that giving an elongated body shape to the guiding structure will decrease the angular velocity by increasing the moment of inertia one can see that this is not the case because the parameter d is also increased thus offsetting the gain in selecting an elongated form.

Therefore, in order to decrease the angular velocity of the guiding structure, the inventors have determined that by selecting a "sector" shape for the guiding structure and putting the pivot point substantially close to the center of the circle forming the "sector", as illustrated in FIGS. 5–8, the moment of inertia is increased while maintaining a relatively small distance d (distance from the impact point to the pivot point). As a result, the angular momentum in the embodiments of the guiding structure, illustrated in FIGS. 5–8, is smaller than the angular momentum of the guiding structure illustrated in FIG. 2. Experimental tests have shown that the lifespan (i.e., number of shots of nails before breakage) of the biasing spring in the embodiments using a sector-shape guiding structure is at least ten folds that of the biasing spring in the embodiments using the "L-shape" guiding structure and that independently from the choice of the biasing spring. Actual measurements have shown that the lifetime of the biasing spring in the case of the "sector" shape guiding structure is approximately 37000 shots, whereas the lifetime of the biasing spring in the case of "Lshape" guiding structure is only approximately 2000 shots. In addition to increasing the lifetime of the biasing spring, the guiding structure with a sector-like design provides a more compact design thus allowing the user of the fastener driving device to more easily locate an opening in a workpiece.

As can be appreciated from the above disclosure, the fastener driving device 10 is particularly adapted to drive fasteners through openings, such as opening 52, in an outer workpiece 54 into another workpiece 51 to fasten the workpieces together. The fastener driving device 10 comprises a housing assembly 12 constructed and arranged to be manually portable, the housing assembly 12 including a nosepiece 18 defining a drive track 28. The fastener driving device 10 also comprises a magazine assembly 14 cooperating with the housing assembly 12 to define a fastener feed track leading to the drive track 28. The magazine assembly 14 is constructed and arranged to retain a package of fasteners and to feed successively leading fasteners of the fastener package along the fastener feed track and into the drive track 28. The fastener driving device 10 further comprises a fastener driving element 38 movable within the drive track 28 and arranged to drive a leading fastener fed to the drive track 28 outwardly thereof into a workpiece during a fastener driving stroke. In addition, the fastener driving device 10 also comprises a power operated system such actuating valve 36 which is constructed and arranged to move the fastener driving element 38 through successive operating cycles including a fastener driving stroke and a return stroke.

The fastener driving device 10 further includes an actuating mechanism including a trigger assembly 37 arranged to be actuated by a manual movement and a contact trip assembly 42 arranged to be actuated by a movement of the housing assembly through an actuating stroke toward a workpiece (such as workpiece 54). The actuating mechanism is constructed and arranged to actuate the power operated system such as actuating valve 36 in response to a predetermined actuation of the trigger assembly 37 and the contact trip assembly 42.

The contact trip assembly 42 includes an actuating structure 45 movable with respect to the housing assembly 12 and cooperating with the trigger assembly 37. The contact trip assembly 42 also includes an opening locating structure 60 movable with respect to the actuating structure 45. The opening locating structure 60 is constructed and arranged to engage within opening 52 to initiate the actuating stroke of the housing assembly 12 so that during an initial portion of the actuating stroke both the housing assembly 12 and the actuating structure 45 move with respect to the opening locating structure 60 and during a subsequent portion of the actuating stroke the housing assembly 12 is moved with respect to both the opening locating structure 60 and the actuating structure 45.

It is recognized that, since the device is portable, it will not always be oriented in a manner to fit the directional words used herein which are accurate when the device is being operated in a vertical direction on a horizontal surface.

While the invention has been described in connection with particular embodiments, it is to be understood that the invention is not limited to only the embodiments described, but on the contrary it is intended to cover all modifications and arrangements included within the spirit and scope of the invention as defined by the claims, which follow.

What is claimed is:

1. A fastener driving device particularly adapted to drive fasteners through openings in an outer workpiece into another workpiece to fasten the workpieces together, said fastener driving device comprising:

a housing assembly constructed and arranged to be manually portable, said housing including a nosepiece defining a drive track;

a magazine assembly defining a fastener feed track leading to said drive track, said magazine assembly being constructed and arranged to retain a package of fasteners and to feed successively leading fasteners of the fastener package along the fastener feed track and into the drive track;

a fastener driving element movable within said drive track and arranged to drive a leading fastener fed to said drive track outwardly thereof into a workpiece during a fastener driving stroke;

a power operated system constructed and arranged to move said fastener driving element through successive operating cycles including a fastener driving stroke and a return stroke;

an actuating mechanism including a trigger assembly arranged to be actuated by a manual movement and a contact trip assembly arranged to be actuated by a movement of the housing assembly through an actuating stroke toward a workpiece, said actuating mechanism being constructed and arranged to actuate said power operated system in response to a predetermined actuation of said trigger assembly and said contact trip assembly, said contact trip assembly including an actuating structure movable with respect to said housing assembly and cooperating with said trigger assembly, and an opening locating structure movable with respect to said actuating structure constructed and arranged to engage within the opening to initiate the actuating stroke of the housing assembly so that during an initial portion of the actuating stroke both the housing assembly and the actuating structure move with respect to said opening locating structure and during a subsequent portion of the actuating stroke said housing assembly is moved with respect to both said opening locating structure and said actuating structure.

2. The fastener driving device as defined in claim 1, wherein said opening locating structure is spring biased to move with respect to said actuating structure between an extended viewing position and a retracted actuating position, and said actuating structure is spring biased to move with respect to said housing assembly between an extended position and a retracted actuating position.

3. The fastener driving device as defined in claim 2, wherein said opening locating structure is mounted, for movement between said extended viewing position and said retracted actuating position, on a rigid structure forming an adjustable part of said actuating structure, said rigid structure including an annular portion receiving a free end of said nosepiece, said opening locating structure including a tapered element extending in viewing relation from said annular portion when in said extended viewing position.

4. The fastener driving device as defined in claim 3, wherein said annular portion has a fastener guiding member mounted therein for spring biased movement in a direction to engage a fastener being driven and guide it into engagement with said tapered element.

5. An opening locating mechanism for use with a fastener driving device for enabling said fastener driving device to drive fasteners through an opening in an outer workpiece into another workpiece to fasten the workpieces together, the fastener driving device being of the type comprising: a housing assembly constructed and arranged to be manually portable, said housing including a nosepiece defining a drive track; a magazine assembly defining a fastener feed track leading to said drive track, said magazine assembly being constructed and arranged to retain a package of fasteners and to feed successively leading fasteners of the fastener package along the fastener feed track and into the drive track; a fastener driving element movable within said drive track and arranged to drive a leading fastener fed to said drive track outwardly thereof into a workpiece during a fastener driving stroke; a power operated system constructed and arranged to move said fastener driving element through successive operating cycles including a fastener driving stroke and a return stroke; and an actuating structure; said opening locating mechanism including:

a rigid structure adapted to be adjustably fixed to said actuating structure for movement therewith, said rigid structure including an annular portion constructed and arranged to receive a free end of the nosepiece therein and a tapered opening locating element mounted on said rigid structure for movement between an extended viewing position extending in viewing relation from said annular portion and a retracted actuating position.

6. The opening locating mechanism as defined in claim 5, wherein said opening locating structure is spring biased to move with respect to said actuating structure between an extended viewing position and a retracted actuating position, and said actuating structure is spring biased to move with respect to said housing assembly between an extended position and a retracted actuating position.

7. The opening locating mechanism as defined in claim 6, wherein said opening locating structure is mounted, for movement between said extended viewing position and said retracted actuating position, on a rigid structure forming an adjustable part of said actuating structure, said rigid structure including an annular portion receiving a free end of said nosepiece, said opening locating structure including a tapered element extending in viewing relation from said annular portion when in said extended viewing position.

8. The opening locating mechanism as defined in claim 7, wherein said annular portion has a fastener guiding member mounted therein for spring biased movement in a direction to engage a fastener being driven and guide it into engagement with said tapered element.

9. A fastener driving device comprising:

a frame structure presenting a handle portion constructed and arranged to be gripped by a user enabling the user to handle the device in portable fashion;

a nosepiece structure operatively fixed with respect to said frame structure defining a fastener drive track;

a fastener driving element movable through drive track;

a power operated fastener driving system carried by said frame structure constructed and arranged to move said fastener driving element through successive operating cycles each including a drive stroke and a return stroke;

a magazine assembly carried by said frame structure having fixed structure defining a fastener feed track leading to said drive track and movable structure constructed and arranged to enable a package of fasteners to be loaded in said magazine assembly and fed along said feed track so that the leading fastener of the fastener package is moved into said drive track to be driven outwardly thereof into a workpiece during the drive stroke of the fastener driving element;

an actuating mechanism constructed and arranged to actuate said power operated driving system including a manually actuatable trigger assembly and a contact trip assembly; said contact trip assembly comprising a trigger enabling portion and a movable assembly coupled to said trigger enabling portion, said contact trip assembly being constructed and arranged to be movable between an extended position and a retracted position whereby said trigger enabling portion enables said trigger mechanism to activate said fastener driving element when actuated by a user when said contact trip assembly is in said retracted position and disables said trigger mechanism when said contact trip assembly is not in said retracted position; said contact trip assembly being constructed and arranged to be biased toward said extended position and to be moved toward said retracted position when said movable assembly engages a workpiece by pressing said frame structure toward said workpiece, thereby moving said contact trip assembly with respect to said nosepiece;

a positioning mechanism constructed and arranged to position the nosepiece structure into an opening in a first workpiece such that a fastener is driven through the opening to fasten said first workpiece to a second workpiece, wherein said positioning mechanism comprises:

an opening locating structure movably connected to the movable assembly of the contact trip assembly and adapted to extend into the opening so as to align the nosepiece with respect to the opening, said opening locating structure and said movable assembly of the contact trip assembly being movable relative to one another between an extended position and a retracted position and said opening locating structure being biased toward the extended position to facilitate locating of the opening, and movable to the retracted position when the opening locating structure is pressed against the first workpiece.

10. The fastener driving device as recited in claim 9, further comprising:

a guiding structure movably connected to the nosepiece structure, the guiding structure being biased by a biasing spring to extend forwardly to guide the fastener in the driving track.

11. The fastener driving device as recited in claim 10, wherein the guiding structure is biased by the biasing spring such that when a fastener is introduced into the drive track said guiding structure forces a pointed end of said fastener to be proximate to the opening locating structure.

12. The fastener driving device as recited in claim 10, wherein the guiding structure is biased by the biasing spring such that when a fastener is introduced into the drive track said guiding structure forces a pointed end of said fastener to be proximate to the opening locating structure.

13. The fastener driving device as recited in claim 10, wherein the guiding structure is constructed and arranged to pivot around a pivot axis disposed at an extremity of said guiding structure.

14. The fastener driving device as recited in claim 10, wherein the guiding structure is constructed and arranged to slide perpendicularly to a driving axis defining by the driving track in the nosepiece.

15. The fastener driving device as recited in claim 10, wherein the guiding structure has an oblong shape.

16. The fastener driving device as recited in claim 10, wherein the guiding structure has a sector shape.

17. The fastener driving device as recited in claim 9, wherein said opening locating structure is biased toward the extended position using a resilient member.

18. The fastener driving device as recited in claim 17, wherein the biasing spring is disposed between two portions of said opening locating structure.

19. The fastener driving device as recited in claim 17, wherein said resilient member is a biasing spring.

20. The fastener driving device as recited in claim 9, wherein said opening locating structure has a tapered end adapted to extend into the opening.

21. The fastener driving device as recited in claim 20, wherein said tapered end includes a half-cone shape.

22. The fastener driving device as recited in claim 20, wherein said tapered end when introduced in the opening said tapered end occupies half of the opening.

23. The fastener driving device as recited in claim 20, wherein said tapered end acts as a guide arranged to guide the fastener into the opening.

24. The fastener driving device as recited in claim 9, wherein the opening locating structure comprises two flat members arranged to secure the opening locating structure to the nosepiece.

25. The fastener driving device as recited in claim 24, wherein the opening locating structure is prevented from rotation by portions of the nosepiece.

26. An opening locating mechanism for use with a fastener driving device, comprising:

a rigid body adapted to be attached to said driving device, said body having a nose receiving portion adapted to receive a nosepiece of the device;

an opening locating element mounted on said rigid structure, said opening locating element being movable in axial direction generally parallel to a direction in which a fastener is to be driven; and a spring biased fastener guide that contacts the fastener being driven and directs the fastener transversely to said axial direction and towards said opening locating element.

27. An opening locating mechanism as recited in claim 26, wherein said opening locating element has a tapered configuration.

28. An opening locating mechanism as recited in claim 26, wherein said fastener guide has a pivotable member that contacts the fastener.

29. An opening locating mechanism as recited in claim 26, wherein said opening locating member is spring biased downwardly in a direction towards which the fastener is driven.

* * * * *